US011613139B2

(12) United States Patent
Clark

(10) Patent No.: US 11,613,139 B2
(45) Date of Patent: Mar. 28, 2023

(54) ONE HAND BOOK

(71) Applicant: Timothy Constantine Clark, Elmhurst, IL (US)

(72) Inventor: Timothy Constantine Clark, Elmhurst, IL (US)

( * ) Notice: Subject to any disclaimer, the term of this patent is extended or adjusted under 35 U.S.C. 154(b) by 112 days.

(21) Appl. No.: 17/350,920

(22) Filed: Jun. 17, 2021

(65) Prior Publication Data

US 2021/0394546 A1 Dec. 23, 2021

Related U.S. Application Data

(60) Provisional application No. 63/040,353, filed on Jun. 17, 2020.

(51) Int. Cl.

| | |
|---|---|
| ***B42D 9/00*** | (2006.01) |
| ***B42D 9/08*** | (2006.01) |
| ***B42D 3/12*** | (2006.01) |

(52) U.S. Cl.

CPC ..... *B42D 9/082* (2013.01); *B42D 3/12* (2013.01); *B42D 9/088* (2013.01); *B42P 2241/06* (2013.01)

(58) Field of Classification Search

CPC ..... B42D 9/00; B42D 9/082; B42D 9/088; B42P 2241/06

USPC ..... 434/317

See application file for complete search history.

(56) References Cited

U.S. PATENT DOCUMENTS

| | | | | |
|---|---|---|---|---|
| 5,707,240 | A * | 1/1998 | Haas | G09B 5/062 434/409 |
| 2008/0268416 | A1* | 10/2008 | Wallace | G09B 5/062 434/317 |
| 2010/0167258 | A1* | 7/2010 | Ravizza | B42B 5/12 434/317 |

FOREIGN PATENT DOCUMENTS

| | | | | |
|---|---|---|---|---|
| CN | 109515022 A | * | 3/2019 | B42D 3/10 |
| FR | 2809668 A1 | * | 12/2001 | B42D 9/008 |

* cited by examiner

*Primary Examiner* — Kyle R Grabowski
(74) *Attorney, Agent, or Firm* — Erickson Law Group, PC

(57) ABSTRACT

A book includes a front cover and a plurality of pages below the front cover. A plurality of first elements are provided, one element mounted to each of the pages at a unique position on the respective page through the front cover. A page turning device is mounted on the front cover, having a second element that is movable over the front cover by a user to be selectively positioned over a respective unique position, the first elements and the second element being magnetically attracted to each other.

9 Claims, 7 Drawing Sheets

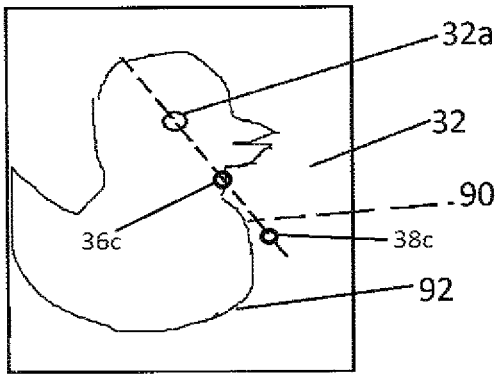
FIG. 5
FIG. 6
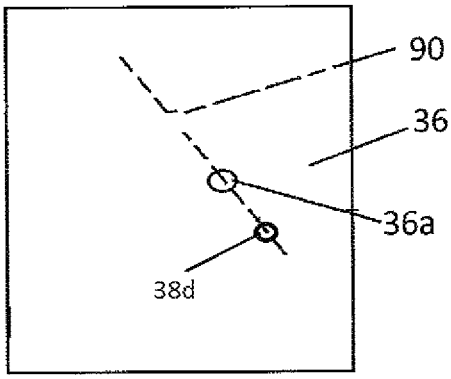
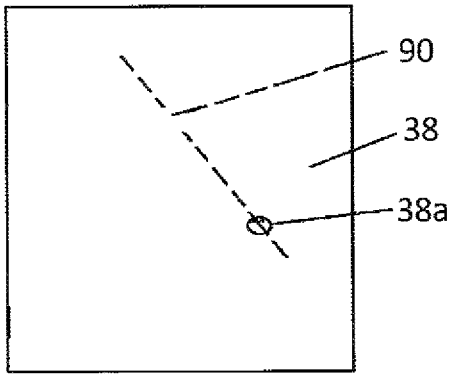
FIG. 7

ONE HAND BOOK

This application claims the benefit of U.S. Provisional Application 63/040,353 filed Jun. 17, 2020.

BACKGROUND

It is known that reading books to small children is beneficial to the child's development as well as beneficial to the bonding between parent and child. For infants and very small children, a parent may desire to hold the infant or small child close with the parent's arm around the child while reading a children's book to the child. In a typical situation, a parent may hold a children's book with one hand so that the parent and child can both read or observe the pages while the other arm and hand surround and support the child on the parent's lap or in a close position next to the parent.

The present inventor has recognized that the parent reading a children's book with a child in the parent's lap or next to the parent must reposition or jostle the child in order to continue holding the book with one hand and to turn the book page with the hand from the arm otherwise surrounding the child.

The present inventor has recognized that it would be desirable to provide a book that could be held, and the pages turned, by the user with one hand.

SUMMARY

An exemplary embodiment of the invention includes a book having a cover and multiple pages, wherein the cover includes a movable magnetic or magnetic-receptive element, such as a ferromagnetic element, such as steel, and each page includes a magnetic or magnetic-receptive element such as a magnet, at a different relative position on the page, viewed or projected through the cover, wherein the movable magnetic or magnetic-receptive element can be positioned in registry with a selected one of the movable magnetic or magnetic-receptive element on a respective page. Each page has its magnetic or magnetic-receptive element located at a different position with respect to the movable magnetic or magnetic-receptive element on the cover such that selective movement of the movable magnetic or magnetic-receptive element magnetically couples with the magnetic or magnetic-receptive element on a selected page.

Also encompassed by the invention is the movable magnetic or magnetic-receptive element on the cover being a magnet, and the magnetic or magnetic-receptive element on each page being a magnetic receptive element, such as a ferromagnetic element, such as composed of steel.

By "ferromagnetic" it is understood to be a material that is attracted to a permanent magnet.

According to one exemplary embodiment, the movable magnetic or magnetic-receptive element on the cover is slidable along a guide to be moved linearly or is attached to a pivot member to be moved in an arc. Additionally, the book can be provided with one or more straps, on both the front and back covers, wherein the user can support the book while at the same time being able to manipulate the ferromagnetic element to turn pages.

The page turning mechanism can be visually incorporated into the cover artwork and the magnetic or magnetic-receptive element applied to the pages can each be visually incorporated into the artwork displayed on the page, adding more interest to the child.

According to another aspect of the invention, the page turning mechanism and the associated magnets can be provided in a kit to retrofit existing, conventional books.

Exemplary embodiments of the invention provide the ability to operate a book, i.e., holding, reading and turning the pages of the book, with one hand. This allows the reader to safely perform other functions with the other hand such as holding and supporting children safely. The exemplary embodiments of the invention also allow a person with a disability or an injury, unable to use one of their hands, the ability to read with one usable hand and operate the book with the one usable hand. The exemplary embodiments of the invention also allow a user to consume food or beverages with one hand while reading a book and operating a book with the other hand, without having to put down the book.

Numerous other advantages and features of the present invention will become readily apparent from the following detailed description of the invention and the embodiments thereof, and from the accompanying drawings.

BRIEF DESCRIPTION OF THE DRAWINGS

FIG. 5 is an elevation view of a first page of the book shown in FIG. 1;

FIG. 6 is an elevation view of a second page of the book shown in FIG. 1;

FIG. 7 is an elevation view of a third page of the book shown in FIG. 1;

DETAILED DESCRIPTION

While various embodiments of the present invention have been described, it should be understood that other modifications and alternatives can be made without departing from the spirit and scope of the invention which should be determined from the appended claims. It is to be understood that no limitation with respect to the specific apparatus illustrated herein is intended or should be inferred.

This application claims the benefit of U.S. Provisional Application 63/040,353 filed Jun. 17, 2020 which is also herein incorporated by reference.

Figure 1:
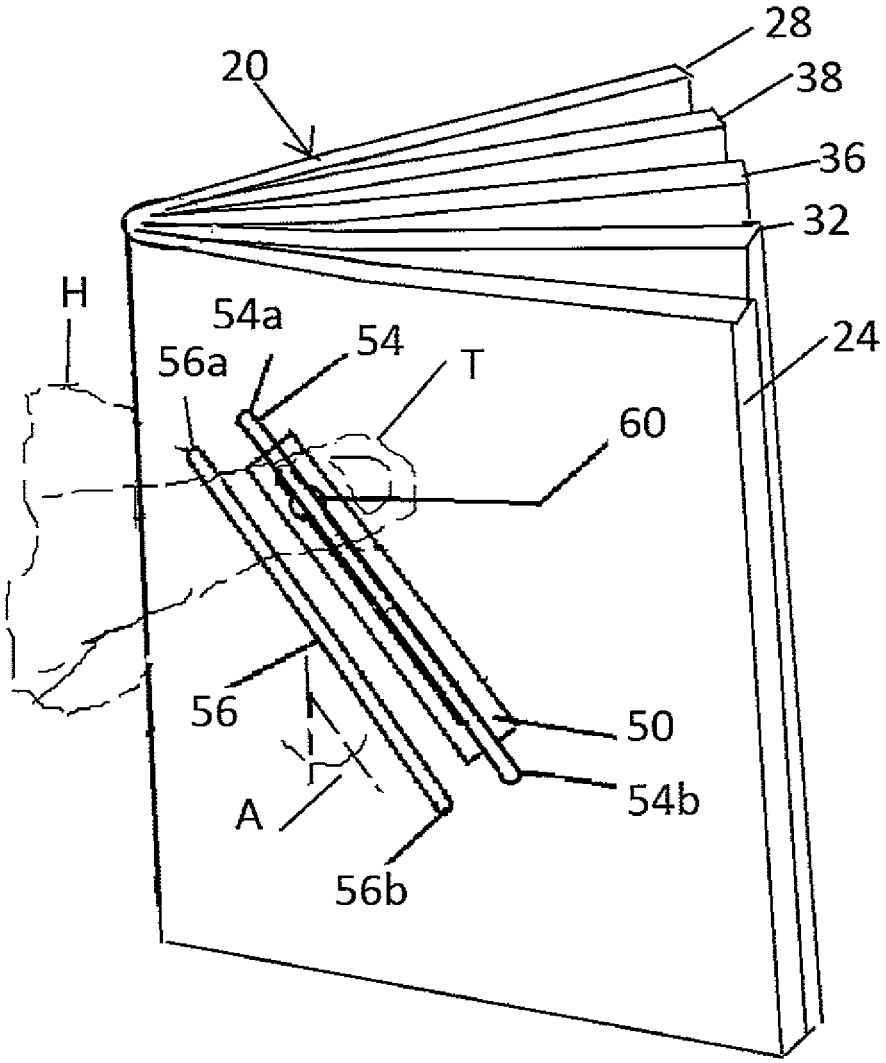
FIG. 1 is a perspective view of a first exemplary embodiment book of the present invention.

FIG. 1 illustrates a book 20 including a front cover 24, a back cover 28, a first page 32, a second page 36, and a third page 38 bound together along a spine 44, such as by adhesive. In the exemplary embodiment, the book 20 is a child's book having cardboard cover and pages, but the invention is not limited to such a construction as it could be adapted for books with thinner paper pages. Although three pages are shown and described, the invention also encompasses a book having less than three pages or more than three pages.

A page turning mechanism 50 is provided on the front cover 24. The page turning mechanism 50 is arranged at an oblique angle A with respect to a spine 44 of the book. The spine 44 binds the cover and pages of the book in known fashion, such as by an adhesive. Two front strap cords 54, 56 are arranged adjacent to or over the mechanism 50. Strap cord 54 is fastened at opposite ends 54*a*, 54*b* to the cover by adhesive or the like. Strap cord 56 is fastened at opposite ends 56*a*, 56*b* to the cover by adhesive or the like. The strap cords 54, 56 each form an arc over the cover 54 to act as straps or handles. There can also be back strap cords 57, 59 (FIG. 3) attached at opposite ends to the back cover 28 that are mirror image identical to the strap cords 54, 56 across a center plane of the book.

A user's hand H is shown holding the book 20. A user's thumb T fits under the front strap cords 54, 56 and can be placed over a ferromagnetic element 60. The user's fingers (not shown) fit under the back strap cords 57, 59 on the back cover 28. With the user's fingers under the back strap cords and thumb under the front strap cords, by moving the user's thumb away from the fingers the book is opened. By closing his thumb toward the fingers, the book is closed. The book 20 can be supported by the user's hand H and manipulated as discussed below.

Figure 2:
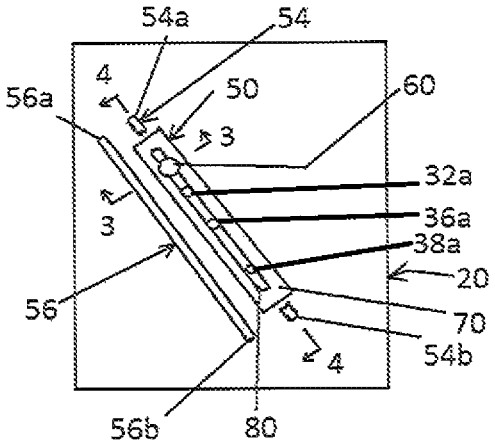
FIG. 2 is an elevation view of the first embodiment shown in FIG. 1.
Figure 3:
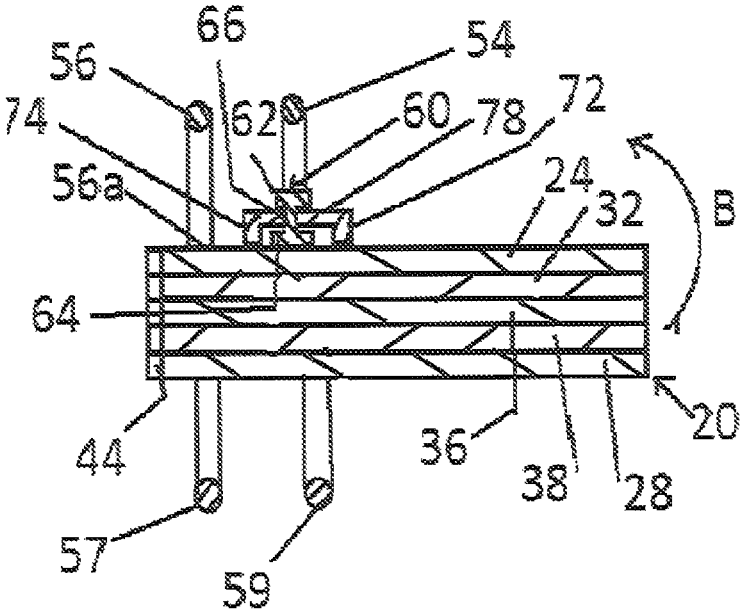
FIG. 3 is a sectional view taken generally through the plane 3-3 in FIG. 2.
Figure 4:
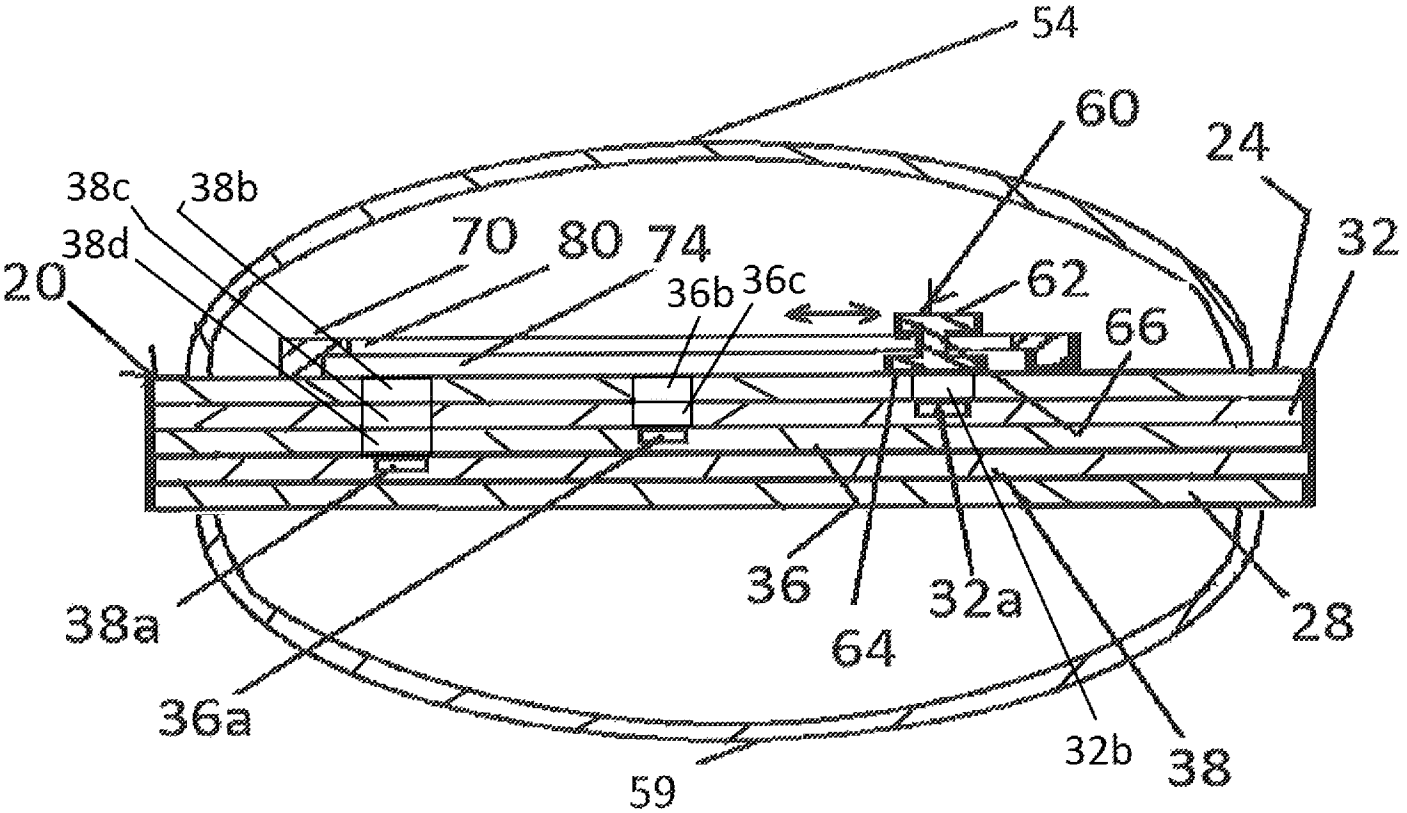
FIG. 4 is a sectional view taken generally through the plane 4-4 in FIG. 2.

FIGS. 2-4 show the page turning mechanism 50 in more detail. The ferromagnetic element 60 is in the shape of a rivet with an enlarged head 62 and an enlarged base 64 connected by a thinner neck 66. A guide 70 is fastened to the front cover 24 by adhesive or other means. The guide 70 includes sidewalls 72, 74 supporting a platform 78 above a surface of the cover. A longitudinal slot 80 is formed through the platform 78. The slot has a width less than the diameter of the base 64 and greater than a diameter of the neck 66 such that the ferromagnetic element 60 is captured within the slot 80 and to the guide 70. The ferromagnetic element 60 can be slid along and through the slot 80 by a user's thumb.

The page turning mechanism 50 can be incorporated into cover art, e.g., the guide can be a playground slide or an elephant's trunk.

Each of the pages 32, 36, 38 includes an attached magnet 32*a*, 36*a*, 38*a* respectively. The magnets 32*a*, 36*a*, 38*a* are located at different horizontal and vertical positions viewed through the front cover of the book. FIG. 2 shows the position of these magnets with respect to the front cover, shown dashed. When the ferromagnetic element 60 is moved down the inclined slot 80, it will register in position sequentially with each of the magnets 32*a*, 36*a*, 38*a*.

As shown in FIG. 4, the cover 24 has an opening 32*b* in registry with the magnet 32*a*. The cover 24 has an opening 36*b* in registry with the magnet 36*a*, and the page 32 has an opening 36*c* in registry with the magnet 36*a*. The cover 24 has an opening 38*b* in registry with the magnet 38*a*, and the page 32 has an opening 38*c* in registry with the magnet 38*a*, and the page 36 has an opening 38*c* in registry with the magnet 38*a*. The openings 32*b*, 36*b*, 36*c*, 38*b*, 38*c*, 38*d* enhance the magnetic force of the ferromagnetic element 60 with each of the magnets, through the cover 24 and the pages 32, 36.

As can be understood, with the book closed, by sliding the ferromagnetic element 60 down to register with the magnet 32*a*, the magnetic attraction between the ferromagnetic element 60 and the magnet 32*a* will effectively attach the first page 32 to the front cover 24 such that opening of the front cover in the rotary direction B, by opening the thumb from the fingers will turn the first page 32 with the cover 24. With the book closed, by sliding the ferromagnetic element 60 down to register with the magnet 36*a*, magnetic attraction between the ferromagnetic element 60 and the magnet 36*a* will effectively attach the second page 36 to the front cover 24 such that opening of the thumb with respect to the fingers will turn together, the front cover 24, the first page 32 (captured between the cover ad the second page 36) and the second page 36. With the book closed, by sliding the ferromagnetic element 60 down to register with the magnet 38*a*, magnetic attraction between the ferromagnetic element 60 and the magnet 38*a* effectively attaches the third page 38 to the front cover 24 such that opening of the thumb with respect to the fingers will turn together the front cover 24, the first page 32 (captured between the cover ad the third page 38), the second page 36 (captured between the cover ad the third page 38), and the third page 38.

As shown in FIG. 3, each magnet 32*a*, 36*a*, 38*a* can be recessed into the respective page 32, 36, 38. Alternately, each magnet can be secured to a surface of the page.

FIGS. 5 through 7 show the first page 32, the second page 36 and the third page 38. Shown dashed on each page is the path of movement 90 of the ferromagnetic element 60 defined by the slot 80. As can be seen the magnets 32*a*, 36*a*, 38*a* are all positioned along this path 90.

FIG. 5 also illustrates an image or decoration 92 on the page that incorporates the magnet 32*a* as part of the image, e.g., the magnet is an eye of a displayed duck. The magnets 36*a* and 38*a* can also be incorporated into an image on pages 36, 38. The magnets 32*a*, 36*a*, 38*a* can be cylindrical or another shape. Incorporating the magnets 32*a*, 36*a*, 38*a* into a page image can be done on all of the pages for both embodiments described herein.

Figure 8:
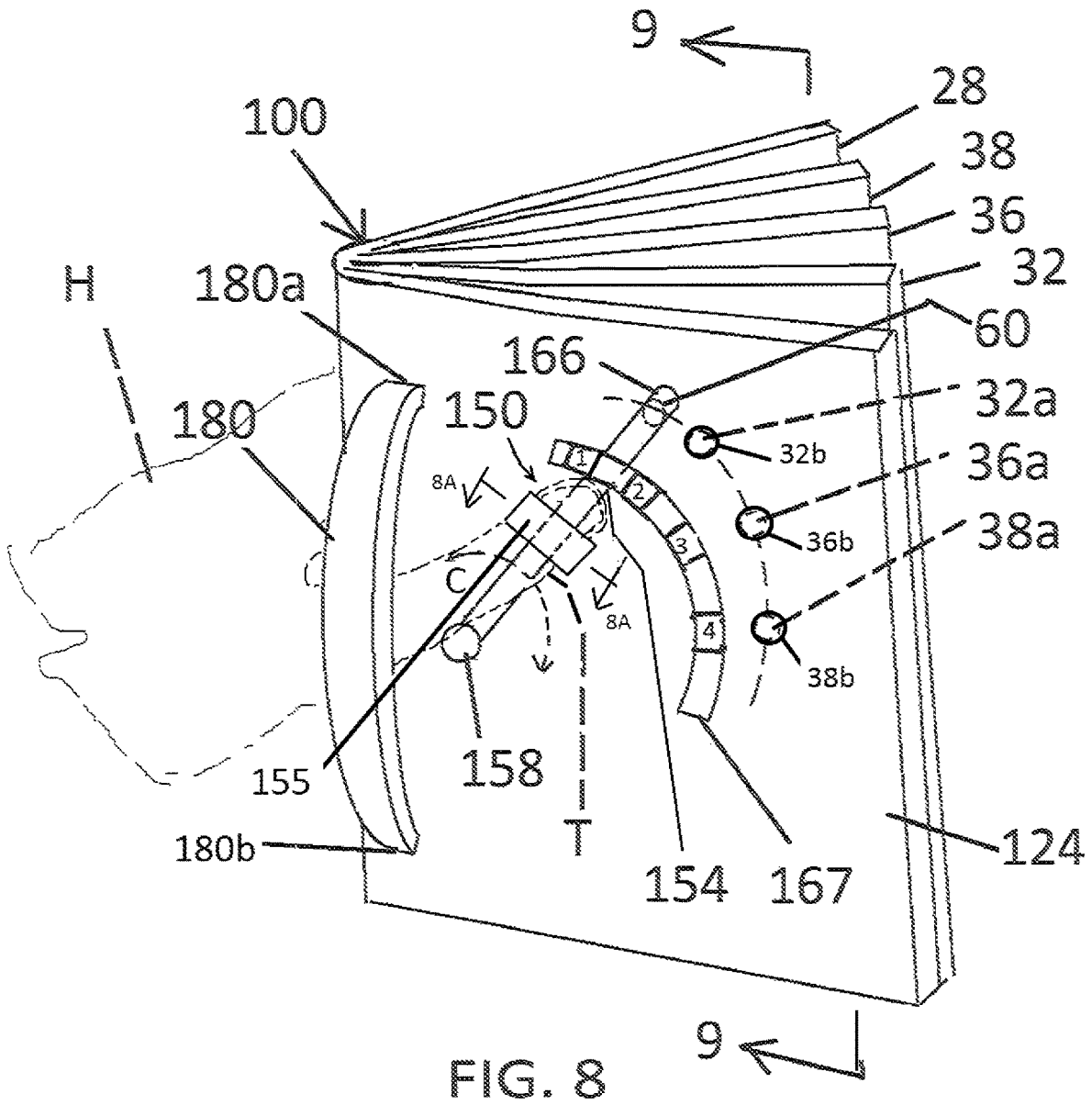
FIG. 8 is a perspective view of a second exemplary embodiment book of the present invention.
Figure 9:
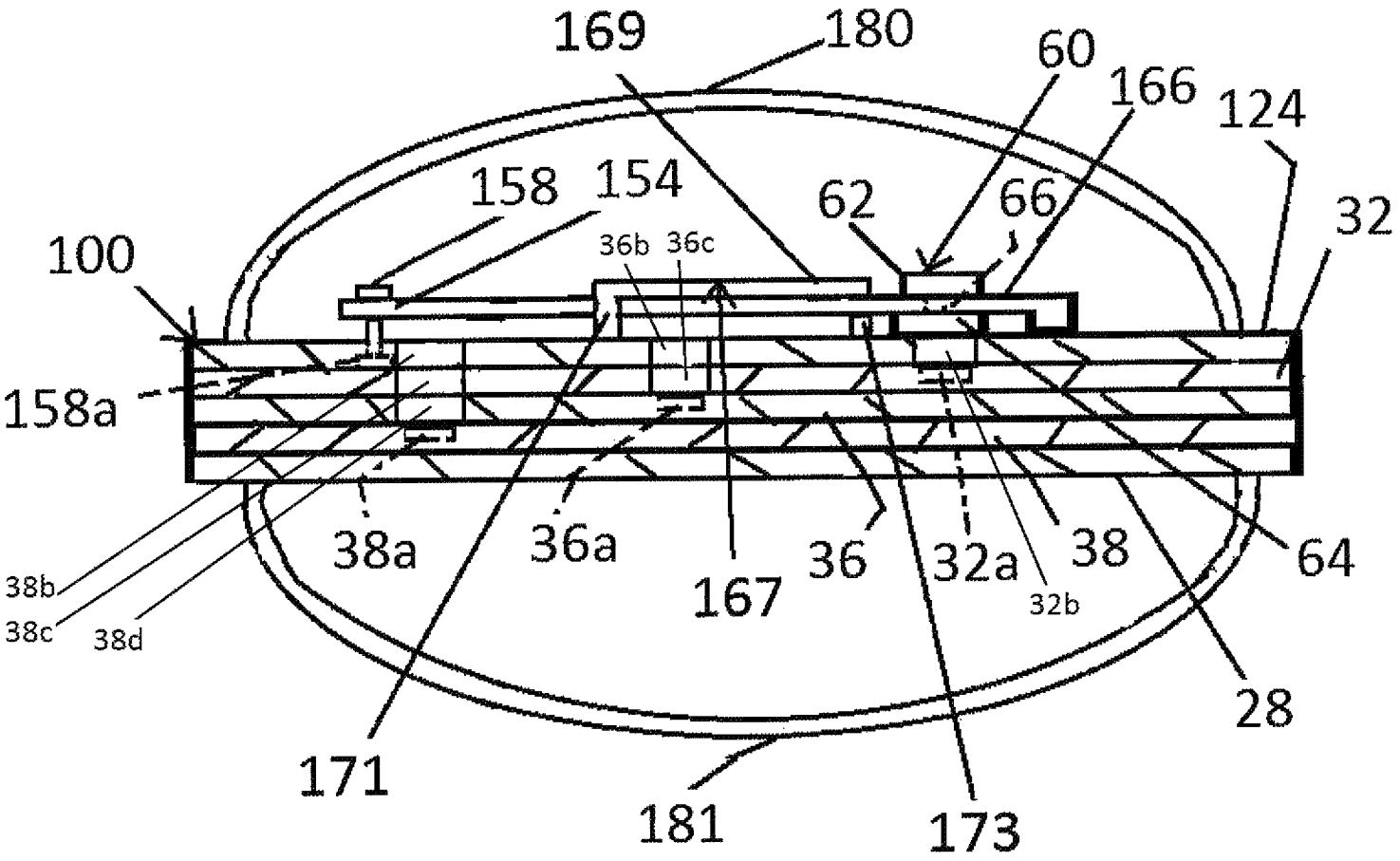
FIG. 9 is a sectional view taken generally through the plane 9-9 in FIG. 8, with the book in FIG. 8 in a closed configuration.

FIGS. 8 and 9 illustrate an alternate embodiment book 100 having an alternate cover 120. An alternate page turning device 150 is applied to the front cover 120. The alternate page turning device 150 includes a lever 154 that is pivotally connected to the front cover 124 by a pin or rivet 158 in order to be pivoted in the rotary direction C. the ferromagnetic element 60 is captured in an opening on an end 166 of the lever 154.

An arcuate guide 167 incudes an arcuate platform 169 raised above the front cover 124 by end walls 171, 173. The lever 154 moves beneath the arcuate platform 169. The arcuate guide 167 acts as a retainer and guard of the lever. The page numbers (1, 2, 3, 4), corresponding to the position of the ferromagnetic element 60 with respect to the underlying magnets 32*a*, 36*a*, 38*a* can be marked on the platform 169.

Figure 8A:
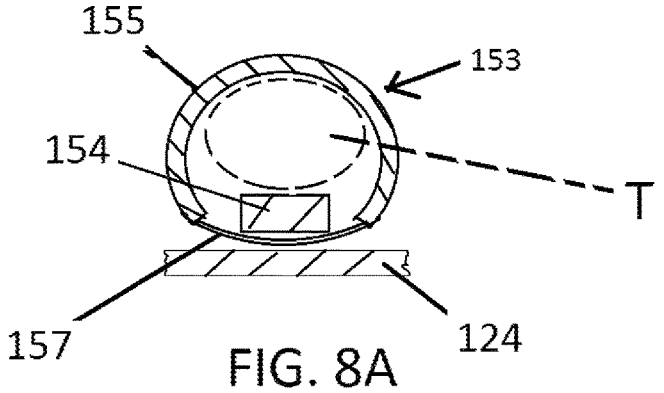
FIG. 8A is a sectional view taken through the plane 8A-8A of FIG. 8.

As shown in FIGS. 8 and 8A, the device 150 include a thumb retainer 153 comprising a cloth strap 155 connected at opposite ends by one or more elastic bands 157. The strap 155 and the bands 157 encircle the user's thumb T and the lever 154. The retainer 153 is slidable along a length of the lever 154 to accommodate users with different length thumbs, i.e., smaller or larger hands. The device is not shown in FIG. 9 for simplicity of description. The device could also be used in the first described embodiment, on the element 60. It is possible that the presence of the device 150 could eliminate the need for the front straps 54, 56 or front strap 180.

Pivoting of the lever 154 defines a curved path 174 of the ferromagnetic element 60. The magnets 32*a*, 36*a*, 38*a* applied to each of the pages 32, 36, 38 respectively are located along the path 174 viewed through the front cover of the book, shown dashed. A front strap 180 is attached at its ends 180*a*, 180*b* to the front cover 120. The strap 180 forms an arc over the front cover with enough clearance from the cover for the user to insert a thumb T under the strap 180 and in contact with the lever 154. A similar rear strap 181 can be attached to the rear cover 28 (FIG. 9) in mirror image fashion to the front strap 180 across a center plane of the book. In this way a user can fit his thumb under the front strap 180 and his fingers under the rear strap in order to hold the book. Opening of the thumb away from the fingers opens the book, closing the thumb toward the fingers closes the book.

As shown in FIG. 9, the cover 124 has an opening 32*b* in registry with the magnet 32*a*. The cover 124 has an opening 36*b* in registry with the magnet 36*a*, and the page 32 has an opening 36*c* in registry with the magnet 36*a*. The cover 124 has an opening 38*b* in registry with the magnet 38*a*, and the page 32 has an opening 38*c* in registry with the magnet 38*a*, and the page 36 has an opening 38*c* in registry with the magnet 38*a*. The openings 32*b*, 36*b*, 36*c*, 38*b*, 38*c*, 38*d* enhance the magnetic force of the ferromagnetic element 60 with each of the magnets, through the cover 24 and the pages 32, 36.

The page turning mechanism 150 can be configured to be incorporated into cover artwork, e.g., the lever can be disguised as a hand of a clock or an arm of a man chopping wood.

Figure 10:
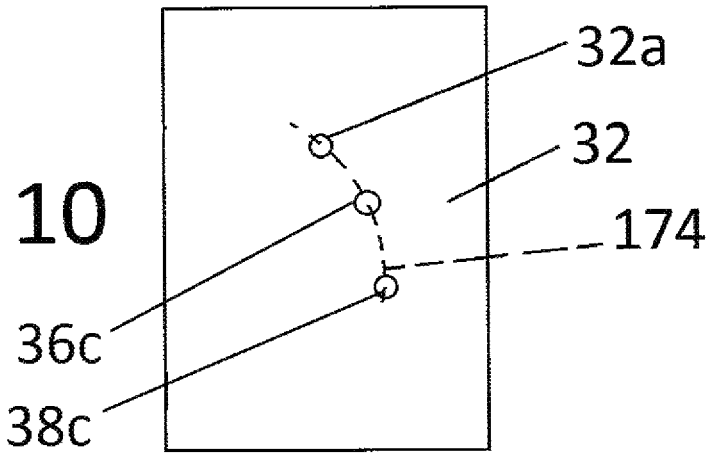
FIG. 10 is an elevation view of a first page of the book shown in FIG. 8.
Figure 11:
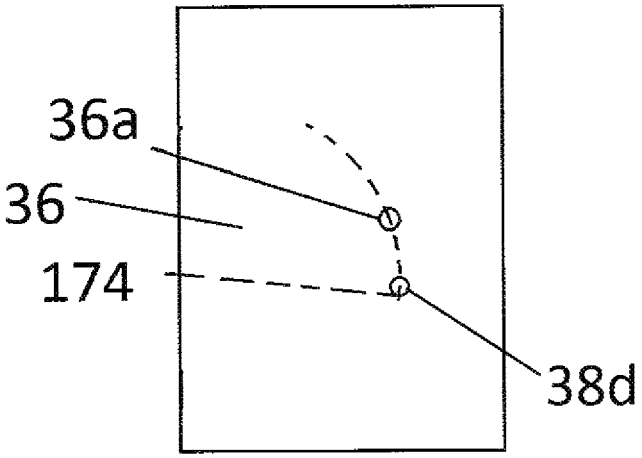
FIG. 11 is an elevation view of a second page of the book shown in FIG. 8.
Figure 12:
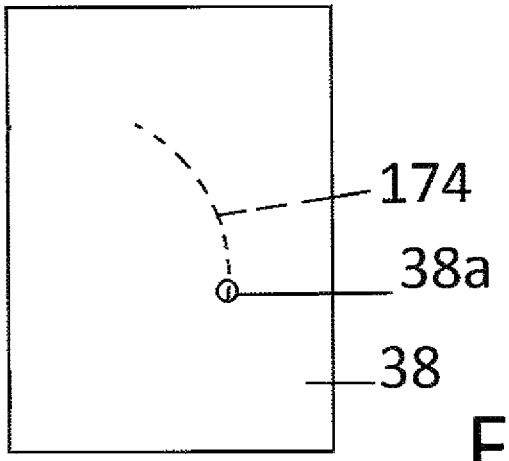
FIG. 12 is an elevation view of a third page of the book shown in FIG. 8.

FIGS. 10-12 show the first page 32, the second page 36 and the third page 38 and the respective magnets 32*a*, 36*a*, 38*a*. The curved path 174 defined by the arc movement of the ferromagnetic element 60 is shown dashed. As can be seen, the magnets 32*a*, 36*a*, 38*a* are all located along the path 174.

The alternate embodiment of FIGS. 8-12 operates substantially the same way as the first described embodiment with the exception that the ferromagnetic element 60 moves in an arc caused by the pivoting lever 154 to select the page by its corresponding magnet, rather than along a line defined by the sliding ferromagnetic element 60 of FIGS. 1 through 7.

Although for ease of description, the element 60 is described as a ferromagnetic element and the elements 32*a*, 36*a*, 38*a* are described as magnets, the materials could be reversed and the element 60 can be a magnet and the elements 32*a*, 36*a*, 38*a* could be ferromagnetic elements, such as steel. Alternately, all of the elements 60, 32*a*, 36*a*, 38*a* can be magnets with correct polarity for attractions between magnets.

The books shown herein are held in the readers left hand with the left thumb on the front cover. An additional possible feature of the books described herein is the fact that the book can be turned over and held with the right hand with the right thumb on the front cover. Normally, this would present the pictures and written material upside down. However, provisions in the pictorial and written materials can be made that the book can be read or viewed with correct orientation when held both ways. For example, alternate pages can have the correct orientation of up and down reversed, or each page could have first portions oriented in a first correct orientation of up and down and then be inverted 180 degrees and have second portions oriented in a second correct orientation of up and down.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit this invention to the specific embodiments illustrated.

The invention claimed is:

1. A book, comprising:

a front cover and a plurality of pages below the front cover;

a plurality of first elements, one element of the plurality of first elements mounted to each of the pages at a unique position on the respective page as projected through the front cover;

a page turning device mounted on the front cover, having a second element that is movable over the front cover by a user to be selectively positioned over a respective unique position, the first elements and the second element being magnetically attracted to each other.

2. The book according to claim 1, wherein the second element is movable along an arc.

3. The book according to claim 1, wherein the second element is movable linearly.

4. The book according to claim 1, wherein the book includes a front strap on the front cover.

5. The book according to claim 4, wherein the book includes a back strap on the back cover.

6. The book according to claim 1, wherein the second element is mounted to a lever that is pivotally connected to the front cover, the lever pivotable by a user's digit thereby the second element is movable on the front cover along an arc.

7. The book according to claim 1, wherein the second element is guided for linearly movement by a slot formed on a guide mounted on the cover.

8. The book according to claim 1, wherein the book includes a front strap on the front cover that is arranged to overlie a user's thumb of a first user's hand when holding the book, wherein the strap is located such that the thumb can extend to the second element in order to either linearly slide or move in an arc the second element.

9. The book according to claim 8, wherein the book includes a back strap on the back cover located to overlie a user's four fingers of the first user's hand.

* * * * *